US006857371B1

(12) United States Patent
Lagrange et al.

(10) Patent No.: US 6,857,371 B1
(45) Date of Patent: Feb. 22, 2005

(54) TWO-PAYLOAD DECOY DEVICE

(75) Inventors: Donald Lagrange, Washington, IN (US); Douglas Shulte, Bloomfield, IN (US); Robert Barker, Linton, IN (US); Charles Howard, Washington, IN (US); Richard Hall, Huron, IN (US); David Dillard, New Castle, DE (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 91 days.

(21) Appl. No.: 10/621,019

(22) Filed: Jun. 19, 2003

(51) Int. Cl.[7] ..... F42B 12/58

(52) U.S. Cl. ..... 102/489; 102/505; 102/377; 89/1.51; 244/137.4

(58) Field of Search ..... 102/489, 377, 102/505; 89/1.51, 1.56; 244/137.4

(56) References Cited

U.S. PATENT DOCUMENTS 3,295,410 A * 1/1967 Edwards ..... 89/1.51
3,508,723 A * 4/1970 Warren et al. ..... 102/377
4,178,854 A * 12/1979 Schillreff ..... 102/377
4,183,302 A 1/1980 Schillreff
4,920,887 A * 5/1990 Frehaut et al. ..... 102/489
5,033,385 A * 7/1991 Zeren ..... 102/489
5,052,270 A * 10/1991 Travor et al. ..... 89/1.51
5,076,134 A * 12/1991 Marshall et al. ..... 89/1.51
5,155,288 A 10/1992 Marshall et al.
5,243,917 A 9/1993 Komstadius
5,359,917 A * 11/1994 Travor ..... 89/1.51
5,623,113 A 4/1997 Valembois

* cited by examiner

*Primary Examiner*—Michael J. Carone
*Assistant Examiner*—Lulit Semunegus
(74) *Attorney, Agent, or Firm*—Mark O. Glut; John Gladstone Mills, III; Naval Air Systems Command

(57) ABSTRACT

The two-payload decoy device has a square outer case, containing a manifold/delay body assembly, a round payload assembly, and a square payload assembly. The square outer case is closed with an end cap. The manifold/delay body assembly is attached to the round payload assembly, which rests against the square payload assembly. Firing a standard impulse cartridge ignites a booster pellet and delay element in the manifold/delay body assembly. Gases flow through openings in the manifold/delay body assembly and down the corner cavities between the round payload assembly and the square case, pushing the square piston against the square payload, which separates the end cap from the case and ejects the square payload. The delay element burns for a specific time, and then ignites a round payload expulsion charge, which creates gases that push the round piston against the round payload, which dislodges a retaining ring, and ejects the round payload.

14 Claims, 2 Drawing Sheets

TWO-PAYLOAD DECOY DEVICE

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

1. Field of the Invention

The present invention relates to decoy devices, more specifically, decoy devices having two payloads with a distinct time lapse between the expulsion of the first payload and the second payload.

2. Description of the Related Art

Decoy devices traditionally have one payload that is ejected by a standard impulse cartridge. Aircraft have a decoy device capacity limited by the number of dispenser holes of the aircraft. Increasing the number of dispenser holes in an aircraft is costly and impracticable. A decoy device, as currently known in the art, typically contains a much larger single payload than is necessary for decoying purposes. There is a need in the art to increase the number of payloads that are ejected by each decoy device, thereby increasing the decoying capacity of an aircraft, while using a single standard impulse cartridge and maintaining standard handling and loading procedures.

U.S. Pat. No. 5,623,113, Valembois, "Pyrotechnic Device for Launching at Least One Projectile", issued Apr. 22, 1997 discloses a device capable of ejecting more than one projectile. The device relies on the inherent ballistic characteristics of each projectile to determine the speed and timing of the launching of the projectile, which requires different calculations of the inherent ballistics for each type of projectile. Developing easily deployable devices with a reliable and predictable delay between the launching of successive payloads is difficult to do using the inherent ballistics of the projectiles, especially in working situations.

Consequently, there is a need in the art for a decoy device capable of deploying two payloads utilizing one standard impulse cartridge. Further, there is a need in the art for a decoy device having a distinct, easily predictable, and reliable time lapse between the expulsion of the first payload and the second payload.

Accordingly, it is an object of the invention to provide a decoy device capable of deploying two payloads.

It is a further object of the invention to provide for a decoy device having an easily predictable, reliable and distinct time lapse between the expulsion of the first payload and the second payload.

It is a further object of the invention to provide for a decoy device that doubles the payload capacity while retaining standard handling and loading procedures.

These and other objects and advantages of the invention will appear from the following detailed description, which together with the accompanying drawings discloses a preferred embodiment of the invention for purposes of illustration only.

SUMMARY OF THE INVENTION

A decoy device capable of deploying two payloads with a distinct and predictable time lapse between the first payload and second payload is disclosed. The device has a square outer case. The aft end of the square outer case is closed and has a cavity with a frangible bottom for a standard impulse cartridge. The forward end of the square outer case is open, which allows for insertion of internal components before an end cap seals the square outer case.

The internal components are comprised of a square payload assembly, a round payload assembly, and a manifold/delay body assembly. The square payload assembly is comprised of a square payload and a square piston located inside the forward end of the outer case. The round payload assembly is located just aft of the square payload assembly and is comprised of a round inner case, a round payload, a retaining ring, and a round piston. The round inner case is attached at its aft end to the manifold/delay body assembly. The manifold/delay body assembly is comprised of a one-piece manifold/delay body, located just aft of the round payload assembly, an expulsion charge for the round payload assembly, at least one booster pellet, and a delay element. The manifold/delay body has a round end located in its forward section and a square end located in the aft. The round end is attached to the round inner case. The round end of the manifold/delay body has a cavity that contains an expulsion charge for the round payload assembly. The square end fits the inside dimensions of the square outer case. The square end of the manifold/delay body has holes located in each of the four corners of the square end. The square end of the manifold/delay body additionally has at least two cavities. The first cavity contains at least one booster pellet. The second cavity contains a delay element. The second cavity has a hole in the bottom of the cavity, creating an opening between the cavity containing the delay element and the cavity in the round end of the manifold/delay body that contains the expulsion charge for the round payload assembly. After the internal components are inserted in the square outer case and the end cap is attached, the manifold/delay body assembly is staked in place by deforming the square outer case inward in each of the four corners just forward of where the square corners of the manifold/delay body assembly are located inside the square outer case.

When a standard impulse cartridge located at the aft end of the square outer case is fired, the frangible bottom of the cavity ruptures, allowing gases from the standard impulse cartridge to ignite the at least one booster pellet and the delay element located in the first and second cavities of the square end of the manifold/delay body. The gases from the impulse cartridge and the at least one booster pellet flow through the four holes in the square end of the manifold/delay body, past the round end of the manifold/delay body, around the round inner case, towards the square payload assembly. The gases from the standard impulse cartridge and at least one booster pellet cause the square piston to push against the square payload, which in turn pushes against the end cap, causing the end cap to separate from the outer case. The square payload is ejected and produces a decoying effect.

The delay element burns for a distinct time, ignites the round payload expulsion charge for the round payload assembly by transferring fire through the hole in the bottom of the delay element cavity. The round payload expulsion charge for the round payload assembly produces gases, pressure from which cause the round piston to push against the round payload, which then pushes against the retaining ring, causing it to separate from the round inner case. The second payload is then ejected and produces a decoying effect.

DETAILED DESCRIPTION OF THE INVENTION

Figure 1:
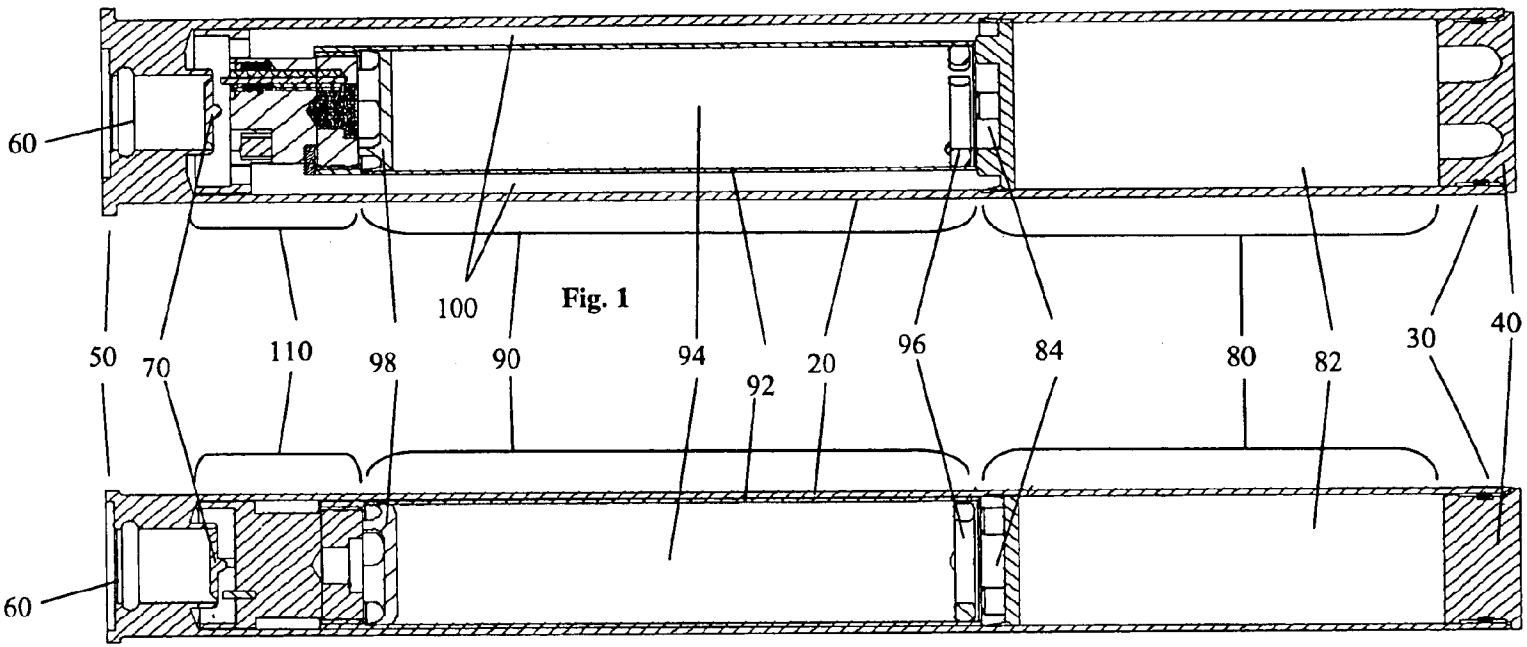
FIG. 1 shows a longitudinal view of the decoy device, in a cross-sectional view B—B from corner to corner of the square outer case.
Figure 2:
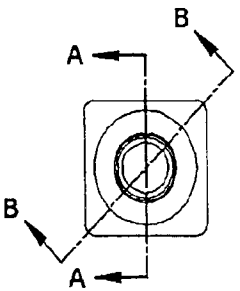
FIG. 2 shows the longitudinal view of the decoy device, in a cross-section view A—A through the midpoint of the square outer case to the opposite midpoint of the square outer case.

The invention disclosed is a two payload decoy device. Referring to FIGS. 1 and 2, the decoy device has an outer square case 20, typically made of aluminum, which measures approximately 1 inch high by 1 inch wide by 8 inches long, which is a standard size designed to fit standard aircraft dispenser holes. It is obvious that the invention can be adapted to differing sizes and/or geometries for applications other than aircraft, or differing sized dispenser holes in aircraft. The outer square case is open at the forward end of the case 30. An end cap 40, typically plastic, is attached at the open end 30 using methods known in the art. Preferably, the end cap is crimped in the open end of the square outer case and sealed with an O-ring. The opposite end of the square outer case, the aft end 50, is closed, and has a cavity 60 designed to accommodate a standard impulse cartridge (not shown). Preferably, the standard impulse cartridge is a BBU-35/B or CCU-145/A impulse cartridge. The bottom of the cavity 60 has a frangible thin disk area 70 separating the standard impulse cartridge from the interior of the outer case 20 of the decoy device.

The internal components of the device are inserted into the open end 30 of the square outer case 20 prior to attaching the end cap 40. The Internal components include a square payload assembly 80, a round payload assembly 90, and a manifold/delay body assembly 110. The square payload assembly 80 is comprised of a square payload 82 located inside the forward portion of the square outer case 20 adjacent to the end cap 40, and a square piston 84, which fits the inner dimensions of the outer case 20, and is located just aft of the square payload 82. Just aft of the square payload assembly 80 is the round payload assembly 90, which is comprised of a round inner case 92 which fits inside the square outer case 20, creating open space 100 between the round inner case 92 and the corners of the square outer case 20 down the length of the round inner case 92. The round inner case 92 contains a round payload 94 that is retained in the round inner case 92 by a retaining ring 96. The square piston 84 of the square payload assembly 80 rests against the retaining ring 96 of the round payload assembly 90. The round payload assembly 90 is further comprised of a round piston 98 located just aft of the round payload 94. The round piston 98 fits the inner dimensions of the round inner case 92. The aft end of the round inner case 92 is attached to the manifold/delay body assembly 110. Typically, the ends of the round inner case 92 and the manifold/delay body assembly 110 are threaded such that they can be screwed together. Additionally, the round inner case 92 and manifold/delay body assembly 110 could be attached by crimping methods such as the rubber die method, the roll crimp method or elecro-magnetic forming, ie. "Magneform®" crimp method. Obviously, other methods of attaching the round inner case to the manifold/delay body assembly are possible in light of the above teachings, and the listing above is not intended to limit the methods of attachment.

Figure 3:
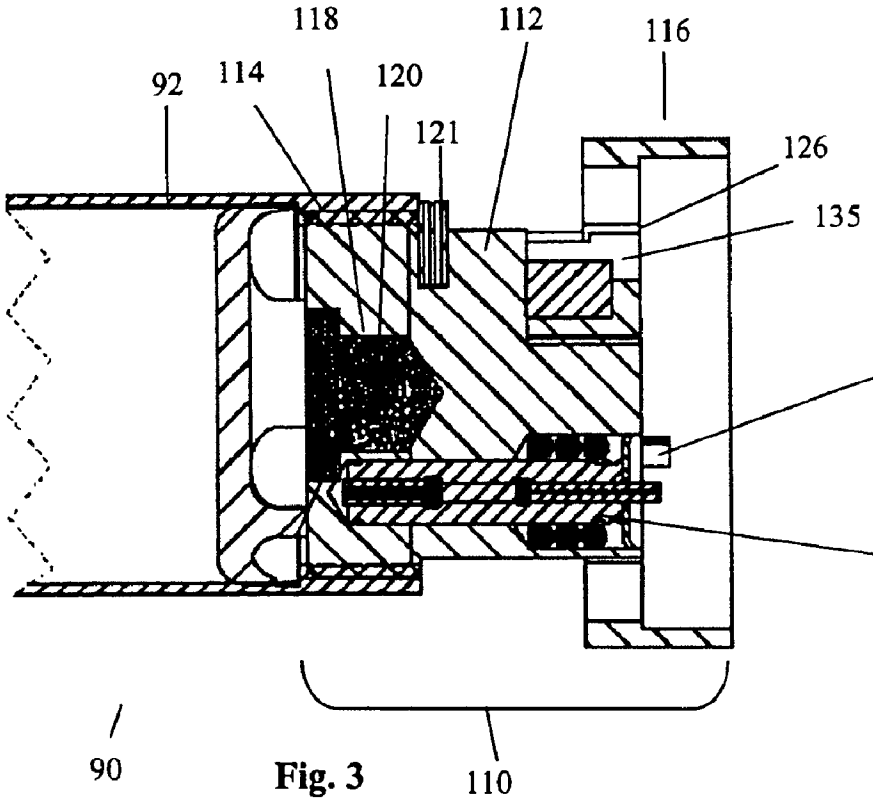
FIG. 3 shows a cross-sectional view of the manifold/delay body assembly.

Referring to FIG. 3, the manifold/delay body assembly 110 is comprised of a one-piece manifold/delay body 112, located just aft of the round payload assembly 90. The manifold/delay body 112 is comprised of a round end 114 located forward and a square end 116 located aft. The round end 114 is attached to the aft end of the round inner case 92 by any means known in the art. Optionally, a pin 121 is inserted in the round end 114 of the manifold/delay body 112 to assist in assembling the manifold/delay body assembly 110 to the round inner case 92 by acting as a stop in the attachment process. Alternatively, a stop could be fabricated as an integral part of the manifold/delay body 112. The round end 114 of the manifold/delay body 112 has a round payload expulsion charge cavity 118 that contains an expulsion charge 120 for the round payload assembly 90. The square end 116 of the manifold/delay body 112 fits the inside dimensions of the square outer case (not shown).

Figure 4:
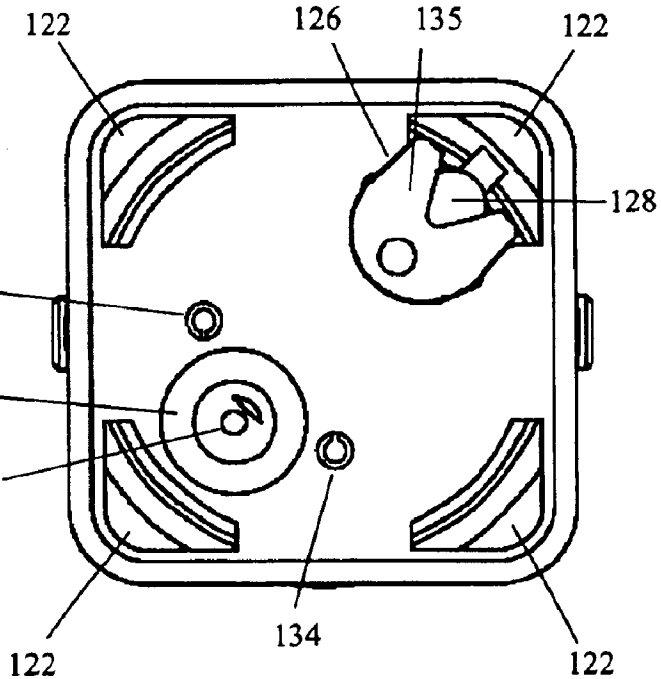
FIG. 4 shows the top view of the manifold/delay body assembly.

FIG. 4 depicts a top view of the square end 116 of the manifold/delay body 112 with at least one hole 122 located in one of the four corners of the square end of the manifold/delay body. Preferably, the square end of the manifold/delay body has four holes 122, one located in each of the four corners of the square end of the manifold/delay body. The square end of the manifold/delay body additionally has at least a first cavity, the booster pellet cavity, 126 and a second cavity, the delay element cavity, 130. The booster pellet cavity 126 contains at least one booster pellet 128, optionally housed in a plastic pellet cup 135. Preferably, the at least one booster pellet is a $BKNO_3$ booster pellet. The delay element cavity 130 contains a delay element 132. Delay elements are known in the art. The delay element cavity 130 has a hole on the bottom surface of the delay element cavity, creating an opening between the delay element cavity 130 and the round payload expulsion charge cavity 118 that is located in the found end of the manifold/delay body. Optionally, the top surface of the manifold/delay body 112 contains at least one pin 134 located as to protect the delay element 132 from being damaged when the frangible thin disk area of the standard impulse cartridge cavity ruptures when the standard impulse cartridge is fired.

Referring to FIGS. 1, 3 and 4, when a standard impulse cartridge (not shown) located in the standard impulse cartridge cavity 60 in the aft end 50 of the square outer case 20 is fired, the frangible thin disk area 70 of the standard impulse cartridge cavity 60 ruptures, allowing gases from the standard impulse cartridge to ignite the at least one booster pellet 128 and the delay element 132. The at least one booster pellet 128 produces additional gases. The gases from the standard impulse cartridge and at least one booster pellet 128 flow through the holes 122 in the four corners of the square end 116 of the manifold/delay body 112, through the open spaces 100 between the round inner case 92 and the corners of the square outer case 20, down the length of the round inner case 92 to the square piston 84. Pressure caused by the gases from the standard impulse cartridge and at least one booster pellet 128 cause the square piston 84 to push against the square payload 82, which in turn pushes against the end cap 40, causing the end cap 40 to separate from the square outer case 20. The square payload 82 is then ejected and produces a decoying effect.

The delay element 132, ignited by the gases from the standard impulse cartridge, burns for a distinct time, and then ignites the round payload expulsion charge 120 for the round payload assembly 90 through the hole in the bottom of the delay element cavity 130. It is known in the art that the physical length and the burn rate of the delay element 132 control the delay time. Once ignited by the delay element 132, the round payload expulsion charge 120 produces gases that create pressure on the round piston 98, causing the round piston to push against the round payload 94, which in turn pushes against the retaining ring 96, causing the retaining ring 96 to separate from the round inner case 92. The round payload 94 is then ejected and produces a decoying effect after a distinct time lapse caused by the delay element.

Having described the invention, the following examples are given to illustrate specific applications of the invention, including the best mode now known to perform the invention. These specific examples are not intended to limit the scope of the invention described in this application.

EXAMPLES

Test devices were built and tested. The two-payload decoy device had an aluminum outer case that measures approximately 1 inch high by 1 inch wide by 8 inches long. A plastic end cap was crimped in the open end and sealed with an O-ring. The opposite end of the case was closed and had a cup shaped cavity designed to accommodate a standard impulse cartridge. Standard impulse cartridges are known in the art. Typically a BBU-35/B or a CCU-145/A standard impulse cartridge is used.

The internal components consisted of a manifold/delay body assembly, containing a $BKNO_3$ booster pellet housed in a plastic pellet cup, a pyrotechnic delay and an expulsion charge, which was screwed to a round inner case. The round inner case contained a round piston and the round payload retained by a C-shaped retaining ring. A square piston rested against the end of the retaining ring of the round inner case. The square piston fitted the inner dimensions of the square outer case. The square first payload was contained between the square piston and the plastic end cap. The end cap with O-ring was Magneform® crimped in the mouth of the one-piece outer case to seal and complete the device. After the plastic end cap was crimped on, the manifold/delay body assembly was staked in place by deforming the square outer case inward in each of the four corners just forward of where the square corners of the manifold/delay body assembly are located.

During testing, the standard impulse cartridge was fired. When the standard impulse cartridge was fired, a thin disk area in the bottom of the cartridge cavity ruptured and the cartridge gases ignited the $BKNO_3$ booster pellet and the pyrotechnic delay. Two standard $BKNO_3$ booster pellets with a weight of 0.067 grams each were used for a total weight of 0.134 grams. Gases from the impulse cartridge and booster pellet flowed through openings in the four corners of the square end of the manifold/delay body and down through the open spaces in the four corners between the round inner case of the second payload and the square case. Pressure from these gases caused the square piston to push against square payload, which in turn pushed against the end cap causing the end cap to separate from the case. The first payload was ejected and produced heat. The delay burned a distinct amount of time and then ignited the expulsion charge for the round payload contained in the manifold/delay body assembly. Gas pressure from the expulsion charge caused the round piston to push against the second payload, which in turn pushed against the retaining ring causing the retaining ring to separate from the round inner case. The second payload was then ejected and produced heat.

Obviously, many modifications and variations of the present invention are possible in light of the above teachings. It is therefore to be understood that, within the scope of the appended claims, the invention may be practiced otherwise than as specifically described.

What is claimed is:

1. A two-payload decoy device comprising:

an square outer case having a closed aft end and an open forward end;

a square payload assembly, located inside the forward end of the outer case;

a round payload assembly, located inside the outer case and aft of the square payload assembly;

a manifold/delay body assembly located inside the square outer case and attached to the round payload assembly, located aft of the round payload assembly, said manifold/delay body assembly having a round end located forward and a square end located aft, said manifold/delay body assembly being staked in place by deforming the square outer case inward in each of the four corners of the square end just forward of where the square corners of the manifold/delay body assembly are located inside the square outer case; and an end cap, said end cap being attached in the open end of the outer case.

2. The two-payload decoy device of claim 1 wherein:

said closed aft end of said square outer case having a cavity having a frangible bottom for receiving a standard impulse cartridge.

3. The two-payload decoy device of claim 1 wherein:

said square payload assembly is comprised of a square payload; and a square piston located aft of the square payload, wherein said square piston fits the inside dimensions of the square outer case.

4. The two-payload decoy device of claim 1 wherein:

said round payload assembly is comprised of a round inner case, having a forward end and an aft end, said round inner case further having threads for attaching a manifold/delay body assembly located at the aft portion of the round inner case;

a round payload, located inside the forward end of said round inner case;

a retaining ring located inside the round inner case forward of the round payload; and a round piston located inside the round inner case aft of said round payload.

5. The two-payload decoy device of claim 1 wherein:

said manifold/delay body assembly is comprised of a one-piece manifold/delay body, said manifold/delay body having a round forward end and a square aft end, said round forward end having a round payload expulsion charge cavity having a hole located in the bottom of said round payload expulsion charge cavity creating an opening to a delay element cavity;

said square aft end of said manifold/delay body having four corners, said corners having at least one hole in at least one corner, said square end further having a booster pellet cavity and a delay element cavity located on the top surface of said square end, said delay element cavity further having an opening in the bottom of said delay element cavity in connection to the opening in the bottom of said round payload expulsion charge cavity;

a round payload expulsion charge located in the round payload expulsion charge cavity;

at least one booster pellet located in said booster pellet cavity; and a delay element located in said delay element cavity.

6. The two-payload decoy device of claim 5 wherein:

the square end of the manifold/delay body assembly further comprises at least one pin located as to protect the delay element.

7. The two-payload decoy device of claim 5 wherein:

the at least one booster pellet is housed in a plastic pellet cup to aid in assembly.

8. The two-payload decoy device of claim 5 wherein:

the round end of the manifold/delay body contains a stop pin to aid in assembly of the manifold/delay body assembly to the round payload assembly.

9. The two payload decoy device of claim 5 wherein:

the at least one booster pellet is comprised of at least 0.067 grams of $BKNO_3$.

10. A two-payload decoy device comprising:

an outer case, having a substantially square cross-section, with an inner dimension and an outer dimension, said outer case further having a forward end and an aft end, said forward end being open, said aft end being closed, said aft end further having a standard impulse cartridge cavity having a frangible bottom;

a square payload assembly located inside said forward end of said outer case, comprising a square payload located at the forward end of the outer case, and a square piston located aft of the square payload, said square piston fitting the inside dimensions of the outer case;

a round payload assembly, comprising a round inner case located aft of said square piston, said round inner case containing a round payload located in the forward end of said round inner case and being retained in said round inner case by a retaining ring resting on said square piston of said square payload assembly, said round inner case further having a round piston fitting the inside dimensions of said round inner case and being located aft of said round payload, said round inner case further having threads located on the aft end of the round inner case for attaching a manifold/delay body assembly;

a manifold/delay body assembly having a round forward end and a square aft end, said round forward end being threaded for attaching to said round payload assembly, said round forward end further having a round payload expulsion charge cavity containing a round payload expulsion charge and having a hole located in the bottom of said round payload expulsion charge cavity creating an opening to a delay element cavity, said square aft end having four corners, said corners having at least one hole in at least one corner, said square end further having a booster pellet cavity containing a booster pellet and a delay element cavity having an opening to said round payload expulsion charge cavity and containing a delay element, said manifold/delay body assembly being staked in place by deforming the square outer case inward in each of the four corners just forward of where the square corners of the manifold/delay body assembly are located inside the square outer case; and an end cap, said end cap being attached in the open end of the outer case.

11. The two-payload decoy device of claim 10 wherein:

the square end of the manifold delay body further comprises at least one pin located as to protect the delay element.

12. The two-payload decoy device of claim 10 wherein:

the at least one booster pellet is housed in a plastic pellet cup to aid in assembly.

13. The two-payload decoy device of claim 10 wherein:

the round end of the manifold/delay body contains a stop pin to aid in assembly of the manifold/delay body assembly to the round payload assembly.

14. The two payload decoy device of claim 10 wherein:

the at least one booster pellet is comprised of at least 0.067 grams of $BKNO_3$.

* * * * *

UNITED STATES PATENT AND TRADEMARK OFFICE

CERTIFICATE OF CORRECTION

PATENT NO. : 6,857,371 B1
DATED : February 22, 2005
INVENTOR(S) : Lagrange et al.

It is certified that error appears in the above-identified patent and that said Letters Patent is hereby corrected as shown below:

Title page,
Item [75], Inventor, "Douglas Shulte" should read -- Douglas Schulte --.

Signed and Sealed this

Twenty-third Day of August, 2005

JON W. DUDAS
*Director of the United States Patent and Trademark Office*